United States Patent [19]

Tholander

[11] Patent Number: 4,627,474

[45] Date of Patent: Dec. 9, 1986

[54] YARN STORING, FEEDING AND MEASURING DEVICE

[75] Inventor: Lars H. G. Tholander, Huskvarna, Sweden

[73] Assignee: Aktiebolaget IRO, Ulricehamn, Sweden

[21] Appl. No.: 614,774

[22] PCT Filed: Sep. 30, 1983

[86] PCT No.: PCT/EP83/00254

§ 371 Date: May 17, 1984

§ 102(e) Date: May 17, 1984

[87] PCT Pub. No.: WO84/01394

PCT Pub. Date: Apr. 12, 1984

[30] Foreign Application Priority Data

| | | | |
|---|---|---|---|
| Sep. 3, 1982 | [SE] | Sweden | 8205598 |
| Dec. 10, 1982 | [SE] | Sweden | 8207096 |
| Sep. 13, 1983 | [SE] | Sweden | 8304891 |
| Sep. 20, 1983 | [SE] | Sweden | 8305040 |
| Sep. 30, 1983 | [WO] | PCT Int'l Appl. | PCT/EP83/00254 |

[51] Int. Cl.[4] ..... D03D 47/36; B65H 51/20

[52] U.S. Cl. ..... 139/452; 242/47.01

[58] Field of Search ..... 139/452; 242/47.01, 242/47.12, 47.13

[56] References Cited

U.S. PATENT DOCUMENTS

| | | | |
|---|---|---|---|
| 3,776,480 | 12/1973 | Lawson | 242/47.01 |
| 3,853,153 | 12/1974 | Van Duynhoven | 139/452 |
| 4,407,336 | 10/1983 | Steiner | 139/452 |
| 4,415,008 | 11/1983 | Keller et al. | 139/370.2 |
| 4,556,088 | 12/1985 | Tanaka et al. | 139/452 |

FOREIGN PATENT DOCUMENTS

| | | | |
|---|---|---|---|
| 652881 | 12/1964 | Belgium . | |
| 0049897 | 4/1982 | European Pat. Off. | 242/47.01 |
| 2908743 | 8/1980 | Fed. Rep. of Germany | 242/47.01 |
| 3140561 | 7/1982 | Fed. Rep. of Germany . | |
| 3123760 | 10/1983 | Fed. Rep. of Germany | 139/452 |
| 1562223 | 4/1969 | France | 242/47.01 |
| 2166332 | 8/1973 | France | 139/452 |
| WO82/04446 | 12/1982 | PCT Int'l Appl. . | |
| EP83/00121 | 5/1983 | PCT Int'l Appl. . | |
| 986539 | 3/1965 | United Kingdom . | |
| 2065726 | 7/1981 | United Kingdom . | |

*Primary Examiner*—Henry S. Jaudon
*Assistant Examiner*—Joseph S. Machuga
*Attorney, Agent, or Firm*—Flynn, Thiel, Boutell & Tanis

[57] ABSTRACT

A yarn storing, feeding and measuring device, particularly for jet looms, has a stationary drum onto which an intermediate yarn store is wound by a winding-on device and from which the yarn is withdrawn, yarn sensing means detecting the withdrawal of the yarn from the drum by generating pulse signals indicating that the yarn passes a detection area of the yarn sensing means, a plurality of yarn stopping devices arranged at angular intervals around the storage drum and a control device adjustable to desired yarn lengths to be withdrawn, said control device being responsive to said pulse signals such that an actuating signal is transmitted to a selected yarn stopping device whose angular position corresponds to the position of the yarn when said desired yarn length has been withdrawn. The yarn sensing means consists of yarn sensors, the number thereof being lower than and independent from the number of yarn stopping devices, and said control device comprises storing means for storing information regarding the yarn stopping device actuated at the end of the previous yarn withdrawal cycle and calculating means for determining one yarn stopping device to be actuated next among the plurality of yarn stopping devices on the basis of input information for the calculating means representing said desired yarn length and on the basis of said stored information.

27 Claims, 8 Drawing Figures

1
2
3
4
5
6
7
8
10
11
12
13
14
15
16
17
18
F

YARN STORING, FEEDING AND MEASURING DEVICE

FIELD OF THE INVENTION

The present invention relates a yarn storing, feeding and measuring device, particularly for jet looms.

BACKGROUND OF THE INVENTION

German Offenlegungsschrift No. 31 23 760 discloses a yarn storing, feeding and measuring device for jet looms having a stationary storage drum onto which an intermediate yarn store is wound by a winding-on device and from which the yarn is withdrawn spiralling around the withdrawal end of the storage drum, yarn sensing means arranged such that the yarn is passing its detection area during withdrawal from the drum, said yarn sensing means producing pulse signals, each pulse signal indicating that the yarn is passing a detection area of the yarn sensing means, a plurality of yarn stopping devices arranged at angular intervals around the storage drum, said yarn stopping devices consisting of yarn stopping elements and actuator means moving said stopping elements into and out of the path of the yarn being withdrawn, and an actuator control device adjustable to a desired yarn length to be withdrawn, said control device being responsive to said pulse signals in such a way that an actuating signal is transmitted to a selected yarn stopping device whose angular position corresponds to the position of the yarn when said desired yarn length has been withdrawn. The yarn sensing means of this prior art device consists in a plurality of yarn sensors, each of said sensors being associated with a yarn stopping device. Hence, the number of yarn sensors required for such a prior art device corresponds to the number of yarn stopping devices. Yarn storing, feeding and measuring devices of the above mentioned kind not only serve to intermediately store the weft yarn on a storage drum, but also serve to supply the jet loom with a weft yarn having a desired length. For the latter purpose, this prior art device carries out the following steps in order to obtain the desired yarn length for each weft yarn insertion: After releasing or deactuating the yarn stopping device actuated at the end of a previous yarn withdrawal cycle the yarn is withdrawn spiralling around the withdrawal end of the storage drum. Thereby, the yarn repeatedly passes the detection areas of the plurality of yarn sensors arranged at the withdrawal end of the storage drum in a spaced, angular relationship with respect to each other. Each yarn sensor generates a pulse signal indicating that the yarn passes its detection area, these pulse signals being fed to the control device. Hence, the control device receives a number of pulse signals, this number corresponding to the number of yarn sensors being passed by the yarn during the withdrawal. By counting the pulse signals received from the yarn sensor the control device generates a count value corresponding to the actual position of the withdrawal point of the yarn with respect to the yarn sensors. The count value corresponds to the length of yarn withdrawn from the storage drum. When the count value corresponds to the desired yarn length to be withdrawn, the control device actuates the stopping device located with respect to the angular movement of the withdrawal point of the yarn behind the yarn sensor which generated the last pulse signal. Thereby, the withdrawal of the yarn is stopped so that the desired yarn length is obtained. This prior art device is costly and complicated due to the large number of yarn stopping sensors required to achieve a sufficiently large number of different yarn lengths. Furthermore, it is undesirable to have a large number of yarn sensors due to the fact that such yarn storing, feeding and measuring devices have to be designed as compact as possible so as to meet with the technical requirements of the customers and users of such devices. A further drawback is caused by the fact that yarn sensors are also sensitive in operation, since they usually comprise optical elements which can be covered by lint. If one of the plurality of yarn sensors is covered by lint, it will no longer generate pulse signals when the yarn passes its detection area resulting in a wrong count value in the control device. Hence, the respective yarn length of the inserted weft yarn will become greater than the desired yarn length.

German Offenlegungsschrift No. 31 23 760 also discloses a yarn storing, feeding and measuring device using only one yarn sensor for detecting the withdrawal of one complete turn of yarn at the withdrawal end of the drum. In order to be able to adjust the yarn length to be withdrawn, this prior art device makes use of a drum whose diameter can be mechanically varied. The same concept is disclosed in French Publication No. 2 166 332 and PCT Published Application No. 82/04446. A mechanical adjustment of the diameter of the drum calls for complicated mechanical means which makes the device costly and liable to malfunctions.

The present invention seeks to improve the device of the above mentioned type so as to give it a simpler, cost-saving structure and a more reliable function without giving up the advantage of adjustability of the yarn length to be withdrawn.

SUMMARY OF THE INVENTION

The control device of the yarn storing, feeding and measuring device in accordance with the present invention comprises a storing means for storing information regarding the yarn stopping device actuated at the end of a previous yarn withdrawal cycle. This enables the control device to have information regarding the withdrawal point of the yarn to be withdrawn at the beginning of each withdrawal cycle without requiring that a yarn sensor be associated to each yarn stopping device. The calculating means determines one yarn stopping device to be actuated next among the plurality of yarn stopping devices on the basis of input information for the calculating means representing the desired yarn length, which can be realised as a simple BCD-switch connected to the calculating means, and on the basis of said stored information regarding the stopping device actuated at the end of a previous yarn withdrawal cycle. This new design enables the device in accordance with the present invention to determine the yarn stopping device to be actuated next without requiring any additional information regarding the withdrawal of the yarn after releasing the stopping device actuated at the end of a previous withdrawal cycle during the movement of the yarn between said released stopping device and the passing of the yarn through the detection area of the yarn sensor. This principle allows reduction of the number of yarn sensors, as the number of yarn sensors becomes independent from the number of yarn stopping devices.

The yarn sensing means can be realized as a single yarn sensor resulting in a very simple structure of the device and further resulting in a simple circuit design of the control device as the control device uses one input-and-amplifier circuit for connecting the yarn sensor to the calculating means.

The device uses information regarding the stopping device actuated at the end of the previous withdrawal cycle which can be directly used as a basis for the determination of the yarn stopping device to be actuated next. Preferably, this stored information can be a number of the stopping device indicating its angular position with respect to said yarn sensor. Furthermore, it is possible to use the value of the angle between the stopping device and the yarn sensor as the stored information. Based on such stored information, the determination of the stopping device to be actuated next can be carried out by transforming the desired yarn length into position numbers of the stopping devices, and to determine the stopping device to be actuated next by summing up the number of the stopping device actuated at the end of the previous withdrawal cycle and the number representing the desired yarn length, wherein this sum is reduced by a number corresponding to one complete turn of yarn, i.e. by the entire number of stopping devices if the sum exceeds said entire number of stopping devices.

The calculating means of the preferred device carries out a very fast and reliable determination of the point of time for actuating the determined stopping device. For this purpose, the calculating means determines on the basis of the desired yarn length an actuation position of the withdrawal point of the yarn being withdrawn from the storage drum at which the determined stopping device is to be actuated. For having a time basis corresponding to the actual withdrawal speed of the yarn from the storage drum the calculating means measures the period of time between the occurrence of two subsequent pulse signals generated by the yarn sensor. Based on this information, the calculating means is enabled to carry out an estimation regarding the withdrawal point of the yarn being withdrawn from the storage drum with respect to the respective position of each yarn stopping device. The calculating means actuates the determined stopping device as soon as the calculated, i.e. estimated, momentary position of the withdrawal point equals said determined actuation position. A rough estimation of said actuation position resulting in the point of time for the actuation of the determined stopping device is sufficient as said determined stopping can be actuated as soon as the withdrawal point of the yarn has passed said stopping device one entire turn of withdrawal before it gets stopped by the stopping device.

An extremely reliable operation of the device can be achieved when designing the calculating means such that it carries out the following calculation steps for determining the estimated, momentary position of the withdrawal point of the yarn. At the beginning of each withdrawal cycle the calculated momentary position is set to a value corresponding to the position of the previously actuated stopping device. After releasing the previously actuated stopping device this value is incremented at a pre-determined rate.

Preferably, the rate is chosen such that the calculated momentary position slips forward with respect to the actual position of the withdrawal point of the yarn. During incrementing of said calculated, momentary position, the calculating means repeatedly checks whether the momentary position equals the position of a yarn sensor or whether the calculated momentary position equals the actuation position. If the first condition is fulfilled, the calculating means holds the calculated, momentary position until the yarn sensor generates a pulse signal. By adaptedly choosing the pre-determined rate for the incrementation of the calculated, momentary position, the calculating means only holds the calculated, momentary position and checks whether the yarn store sensor generates a pulse signal during a very short period of time, which can be considered as a time-window for checking whether the yarn sensor generates a pulse signal. This enables the calculating means to work with high reliability as noise peaks which might occur before and after opening and closing the time-window are disregarded. As soon as the calculating means receives a pulse signal generated by the yarn sensor, it continues the calculation with the step of periodically incrementing the calculated, momentary position, as the generation of said pulse signal indicated that the calculated momentary position equals the real position of the withdrawal point of the yarn. As soon as the momentary position of the withdrawal point of the yarn equals the actuation position, the calculating means actuates the determined stopping device by supplying it with an actuation current.

It can be guaranteed that the movement of the stopping element of the determined stopping device has been completed even when making use of relatively slow stopping devices in high-speed yarn storing, feeding and measuring devices which usually withdraw the yarn from the storage drum with a rotational speed of about 10 milliseconds per revolution. More particularly, the actuation position of the withdrawal point of the yarn being withdrawn from the storage drum is determined such that the period of time lapsing during the movement of the withdrawal point of the yarn from said actuation position to the position of the stopping element of the determined stopping device is preferably 1–5 milliseconds greater than the response time of said stopping device, said response time being defined by the time delay between feeding an actuation current to the actuator means of the stopping device and the completing of the movement of the stopping element. In case the response time is in the order of 5 milliseconds, the stopping device will thus be actuated 6–10 milliseconds before the withdrawal point of the yarn arrives at the position of the stopping element of the determined stopping device.

A calculated, momentary position of the withdrawal point of the yarn can be used as a basis for timely actuating the determined stopping device. In particular, the calculating means controls the actuation of the determined stopping device to be actuated next by estimating the position of the withdrawal point of the yarn and by periodically correcting said position each time the yarn sensor generates the pulse signal.

In a modified teaching the calculation of a momentary position of the withdrawal point is replaced by a time-calculation. In each of these two cases the calculating means can be a simple standard-microprocessor being adapted to these purposes by a few interface-circuits and by a short programme for carrying out the respective calculation.

In particular, the calculating means determines on the basis of the desired yarn length an actuation time defining the period of time between releasing the stopping device actuated at the end of a previous withdrawal cycle and actuating the determined stopping device to be actuated next. There is a linear dependency between the desired yarn length and the actuation time, so that the information regarding the desired yarn length can be used as a basis for calculating said actuation time. The calculating means calculates the period of time lapsed since the releasing or deactuation of said stopping device actuated at the end of the previous withdrawal cycle and periodically corrects this calculation of the period of time on the basis of the respective periods of time between two subsequent pulse signals received from the yarn sensor. By doing so, the calculation of the period of time can be adapted to a varying speed of withdrawing the yarn from the storage drum. In other words, the respective period of time between two subsequent pulse signals serves as a time basis for the calculation of the period of time lapsed since the releasing or deactuation of the stopping device actuated at the end of the previous withdrawal cycle. As soon as the calculated period of time corresponds to the determined actuation time, the calculating means generates an actuation signal for actuating the actuator means of the determined stopping device.

By properly designing the calculating means the calculated period of time lapsed since the releasing or deactuation of the stopping device actuated at the end of the previous withdrawal cycle can be considered as a representation of the momentary position or angular position of the withdrawal point of the yarn being withdrawn from the storage drum. By doing so, the generation of one pulse signal per revolution of the yarn withdrawn from the storage drum is sufficient to generate information regarding the course of the withdrawal point.

When designing the calculating means of the device, a simple and reliable correction of the calculated time with respect to the period of time between two subsequent pulse signals generated by a yarn sensor can be achieved. Preferably, the calculating means is a microprocessor having a memory. One storage cell thereof stores the calculated value representing the calculated period of time. At the beginning of each cycle said value is reset to zero by said calculating means when releasing or deactuating the stopping device actuated at the end of the previous withdrawal cycle. Hereinafter, the calculating means increments said value at a predetermined rate and periodically checks whether said value equals the actuation time, or whether said value equals a pre-set time. This pre-set time is chosen to be a few percent, preferably 10%, smaller than the period of time lapsing during the withdrawal of one turn of yarn from the storage drum. Furthermore, the calculating means checks whether said value equals said pre-set time multiplied by n, n being a whole number greater than zero. By doing so, the calculating means detects whether said value equals multiples of the period of time lapsing during the withdrawal of one turn of yarn from the storage drum. In case the value equals the actuation time, the calculating means generates the actuation signal. In case said value equals a pres-set time or a multiple thereof, the calculating means holds said value and waits until the yarn sensor generates the next pulse signal. By doing so, the calculating means generates a time-window for checking whether the yarn sensor generates the next pulse signal. This feature reduces the sensitivity of the device with respect to noise peaks, as the signal received from the yarn sensor is only considered during a very small time-window during which the pulse is expected to occur. As soon as the pulse is detected, the calculating means continues the calculation with the above mentioned periodic incrementation of said value.

As the calculating means of the devices generate information regarding the momentary withdrawal point of the yarn on the storage drum, the calculating means has also continuous information regarding the momentary length of the withdrawn yarn. This information regarding the momentary length of the withdrawn yarn can be preferably used for controlling further operations of the jet loom which have to be carried out in dependency from the momentary length of the yarn withdrawn from the storage drum.

Usually, devices for a jet loom have a jet nozzle for inserting the weft yarn during the process of weaving by means of compressed air, wherein the jet of compressed air generated by the jet nozzle can be controlled by means of a electromagnetic valve operable by a driving current for controlling the feeding of compressed air to said nozzle. Usually, the controlling of said electromagnetic valve has been carried out in synchronism with the rotation of the main shaft of the weaving machine. In such a control, the opening of the valve for feeding compressed air to the jet nozzle has to be carried out a relatively long period of time before deactuating the stopping device actuated at the end of the previous withdrawal cycle for guaranteeing that the jet of compressed air is completely established before deactuating said stopping device. This relatively long period of time was necessary due to the fact that there did not exist a direct synchronism between the operation of the feeding device and the operation of the jet loom. For the same reason, the valve of the jet nozzle is closed a relatively long period of time after actuating the next stopping device at the end of the withdrawal cycle. The energy needed for generating compressed air has been essentially increased in recent years so that it has become desirable to reduce the consumption of compressed air as far as possible.

The information regarding the withdrawn length of yarn as continued in the calculating means of the devices can be used for effectively reducing the consumption of compressed air by controlling the electromagnetic valve by means of the calculating means in time-dependency from the actuation of the respective stopping devices.

The consumption of compressed air can be reduced by closing the valve of the jet nozzle a pre-determined period of time before activating the determined stopping device to be actuated next. By adaptedly choosing said pre-determined period of time the tension of the yarn being withdrawn from the storage drum is essentially reduced shortly before actuating the stopping device. By doing so, the actuation force of the stopping device can be also essentially reduced so that smaller, faster and cheaper stopping devices can be used. By reducing the tension of the yarn shortly before the withdrawal is stopped by an actuated stopping device, it is possible to take care of sensitive and weak yarns.

When carrying out the invention, an optimal time-dependency between the respective actuation and deactuation of the stopping devices and between the respective opening and closing of the valve of the jet nozzle is achieved, as the desired tension of the yarn is established by means of the jet of compressed air when deactuating the stopping device actuated at the end of the previous withdrawal cycle and as the tension of the yarn is rapidly reduced shortly before actuating the next stopping device.

In prior art devices the respective yarn stopping element consists of a metal pin. It has turned out that the sharp edge between the cylindrical wall and the plain, circular upper surface thereof often causes a damaging of the yarn when the yarn is pressed over this sharp edge during deactuation or releasing of said prior art stopping device. Furthermore, the relatively great upper surface of such a pin is liable to stick against a metal core of an electromagnetic coil serving as an actuator means. The devices in accordance with the invention overcome these drawbacks of the prior art devices by replacing said metal pin of the yarn stopping element with a metal ball being movably disposed in a radial bore provided in a guiding portion located close to the withdrawal end of the storage drum. Preferably, the guiding portion is secured to the withdrawal end of the storage drum. Each actuator means comprises an electromagnetic coil being arranged in spaced relationship to said guiding portion so as to define a gap between the guiding portion and the coil. When supplying the coil with the actuation current, the metal ball is attracted by the coil so that the metal ball moves into the gap for stopping the withdrawal of the yarn. Also it is possible to move the metal ball back into the bore by mechanical means after switching off the actuation current, and it has turned out to be a more cost-saving and simple design to use a permanent magnet for this purpose, said magnet being located at one end of said bore.

DETAILED DESCRIPTION

Figures 1, 2, 3, 4:
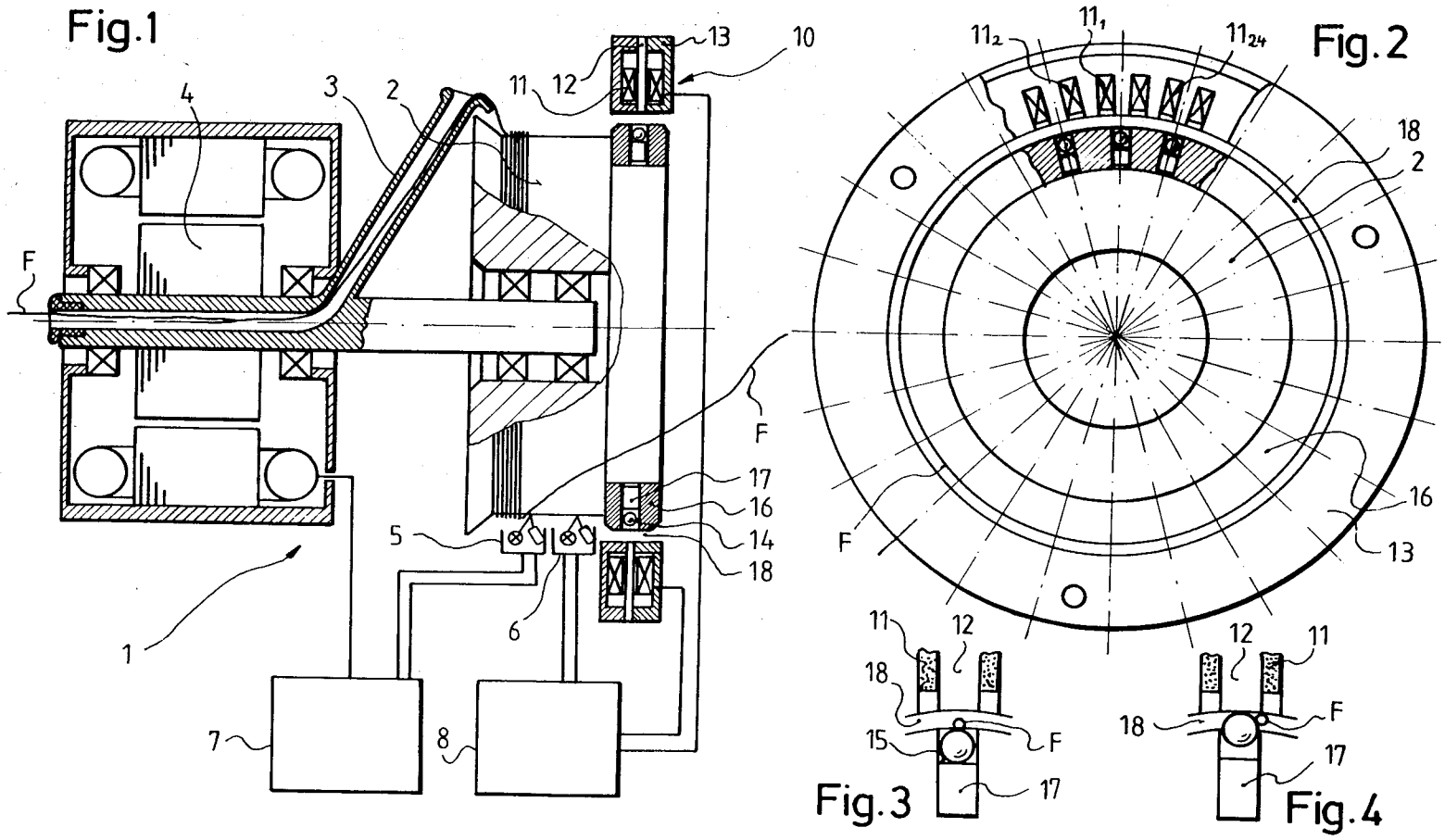
FIG. 1 shows a side view of a device in accordance with the present invention, partially and cross-sectional representation.
FIG. 2 shows a front view of the device as shown in FIG. 1.
FIGS. 3 and 4 show details of the device shown in FIGS. 1 and 2.

Referring now to FIG. 1, a feeding device (1) consists of a storage drum (2), a winding-on device or orbiting feeder tube (3) and an electric motor (4). A yarn (F) being supplied to the orbiting feeder tube (3) driven by the electric motor (4) is wound onto the storage drum (2). This storage drum is a stationary storage drum maintained in a stationary position with respect to its environment by a magnetic means (not shown here). Devices of this type are known per se in the art. For purposes of the present disclosure, it should be noted that this art is exemplified by U.S. Pat. Nos. 3,455,241, 4,226,379, 3,776,480 and 3,843,153. The feeding device (1) is provided with a storage sensor (5) located close to the generally cylindrical surface of the storage drum (2). This storage sensor (5) can be a so-called maximum sensor preferably consisting of a light-emitting device and a light sensing device. This storage sensor (5) generates a signal indicating the amount of yarn stored on the drum, i.e. the number of turns of yarn wound onto the drum. Based on this signal, a storage control unit (7) controls the operation of the electric motor (4) in such a way that there is continuously a sufficient amount of yarn available on the yarn storage drum (2). Storage control units (7) are per se known in the art. For purposes of the present disclosure, it should be noted that this art is exemplified by German Offenlegungsschrift No. 2908743, French Publication No. 1562223 and PCT Application Ser. No. PCT/EP83/00121 owned by the assignee of the present application.

As shown in FIG. 1, there is disposed a yarn sensing means (6) at the withdrawal end of the storage drum arranged such that the yarn is passing its detection area during withdrawal from the drum (2). This yarn sensing means preferably consists of a single yarn sensor (6) producing pulse signals, each pulse signal indicating that the yarn (F) passes a detection area of the yarn sensor (6). This sensor (6) could also be located in front of the withdrawal end of the storage drum, but has to be arranged such that the yarn is passing its detection area during withdrawal from the storate drum (2). A yarn stopping device (10) located at the withdrawal end of the storage drum (2) consists of an actuator means comprising a plurality of electromagnetic coils (11), a plurality of coil cores (12), each of the electromagnetic coils (11) being wound around a coil core (12) supported on a balloon limiting ring (13) consisting of two U-shaped rings covering said plurality of electromagnetic coils (11). Said balloon limiting ring (13) is fixedly secured to the environment of the feeding device (1), for example, to a base plate thereof. A ring-shaped guiding portion (16) is connected to with withdrawal end of the storage drum (2). Said guiding portion (16) supports a plurality of yarn stopping elements, each of said yarn stopping elements consisting of a metal ball (14) movably disposed in a radial bore (15) provided in the guiding portion (16).

As shown in FIGS. 3 and 4, the respective electromagnetic coils (11) and associated cores (12) are arranged opposite to said bores (15). The balloon limiting ring (13) and the guiding portion (16) define a gap (18) being preferably in the order of 1–2 millimeters. The yarn (F) passes said gap when being withdrawn from the storage drum. A permanent magnet (17) is located at one end of each bore (15) for moving said metal ball (14) back into said bore (15) after switching off an actuation current fed to the respective electromagnetic coils (11). As shown in FIGS. 3 and 4, ball (14) is attracted by the magnetic force of coil (11) when switching on the actuation current fed to coil (11). The width of the gap (18) corresponds to the radius of the metal ball (15). When the coil (11) is not activated, the permanent magnet (17) will attract the metal ball (14), so that the ball will be completely positioned inside the bore (15), so that the yar (F) can be freely withdrawn in the axial direction from the storage drum (2).

The magnetic force of each electromagnetic coil (11) is chosen such that this force will overcome the attraction force of the permanent magnet (17) when feeding the actuation current to the coil (11). The metal ball (14) will thereby move outwardly in the radial direction of the bore (15) and come into contact with the free end of the coil core (12). In this condition, approximately half of the metal ball locks the gap (18) for the passage of the yarn (F) in such a way that the withdrawal of the yarn (F) from the storage drum (2) is terminated. When switching off the actuation current fed to the coil (11), the tension in the yarn (F) being pulled at the beginning of the weft yarn insertion co-acts with the magnetic force of the permanent magnet (17) such that the metal ball (14) will return to its starting position so as to come into contact with the permanent magnet (17). As the tension of the yarn co-acts with the magnetic force of the permanent magnet (17) due to the shape of the metal ball (14), the holding force of the permanent magnet (17) can be relatively low. Hence, only a small portion of the attracting force generated by the electromagnetic coil (11) is required for overcoming the magnetic force of the permanent magnet (17). For this reason the yarn stopping device (10) in accordance with the present invention works faster than prior art devices using stopping elements (14) which are needle-shaped or pin-shaped. For further enhancing the operation of the yarn stopping device (10), a thin plate of non-magnetic material can be positioned at the outer end of the permanent magnet (17) and/or on the free end of the coil core (12) for eliminating a magnetic sticking or "adhesion" between the metal ball (14) and the permanent magnet (17) and/or the coil core (12).

The stopping element (14) can also have the form of a short-cylindrical pin with a plain inner end directed to the permanent magnet (17) and a rounded, preferably semi-sperical outer end.

Figure 5:
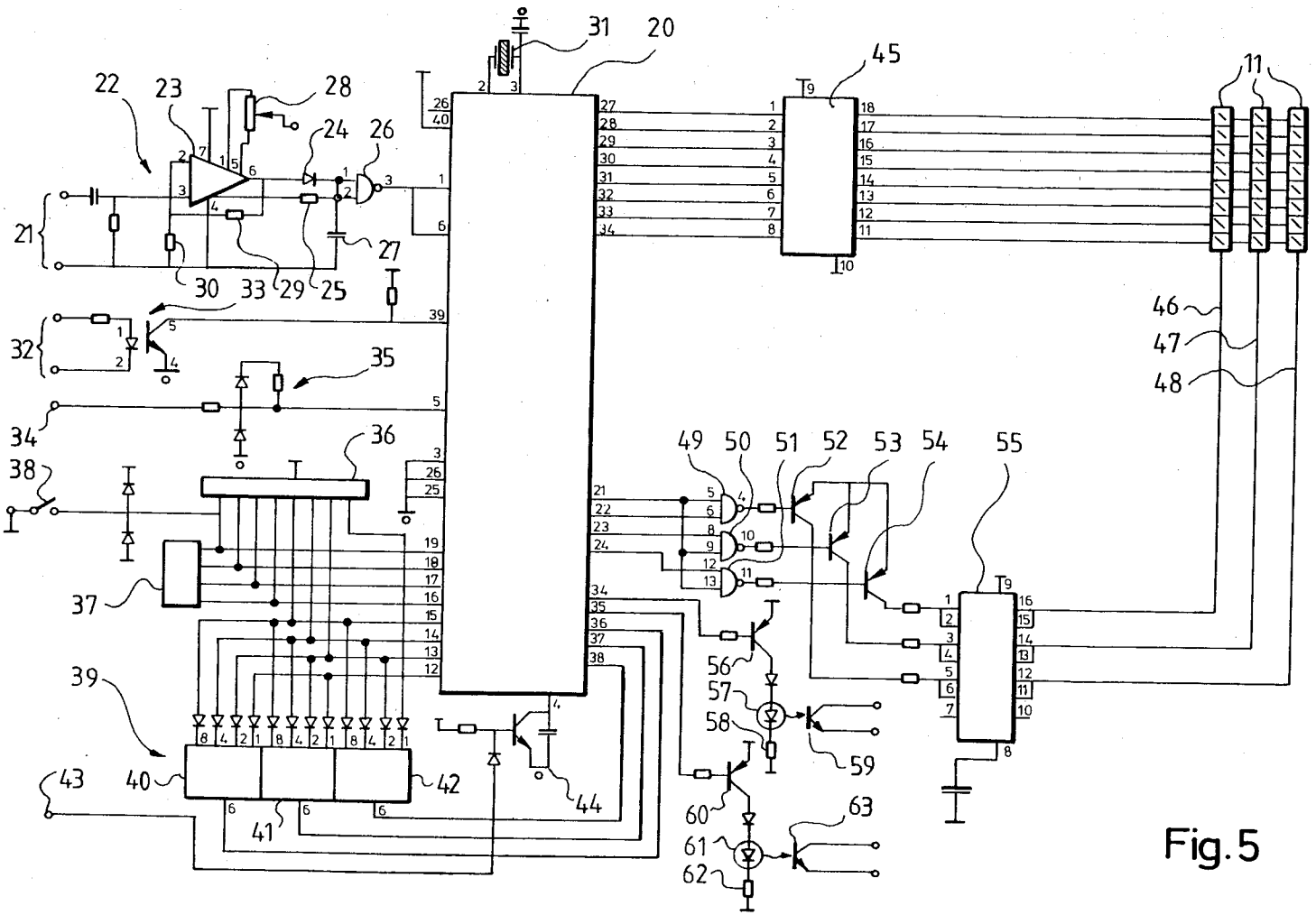
FIG. 5 shows a circuit diagram of a control device of the device shown in FIGS. 1–4.

Referring now to FIG. 5, the control device (8) will be hereinafter descibed in detail. The control device (8) comprises a calculating means (20) which is a standard microprocessor. The microprocessor (20) is preferably a microprocessor of the type 8748, manufactured by the "INTEL" Corporation. The yarn sensor (6) is connected to an input (21) of a yarn sensor interface circuit (22). The yarn sensor interface circuit (22) essentially consists in an operational amplifier (23) connected through a diode (24) and a resistor (25) in parallel connection to diode (24) to an inverter gate (26), the output thereof being connected to input pins Nos. 1 and 6 of the microprocessor (20). The input terminals of the inverter gate (26) are connected to ground via a capacitor (27). The gain of the operational amplifier (23) can be adjusted by a variable gain control resistor (28) connected to the operational amplifier (23). When a pulse is generated by the yarn sensor (6), it will be current-amplified by the operational amplifier (23). The output current of the operational amplifier (23) passes the diode (24) and charges the capacitor (27). When the pulse signal goes back to zero potential, the capacitor (27) is discharged through resistors (25), (29) and (30) to ground. Due to the switching threshold of the inverter gate (26), only pulses of a pre-determined voltage are detected, so that the yarn sensor interface circuit (22) disregards small noise voltages. As the capacitor can be quickly charged through diode (24) and is only slowly discharged through resistors (25), (29) and (30), short input pulses are transformed to longer output pulses as generated by gate (26). Such a broadening of the very short input pulses enables the microprocessor (20) to reliably detect the input pulses.

The microprocessor (20) is supplied with pulse signals generated by a crystal resonator (31) connected to input pins Nos. 2 and 3 of the microprocessor.

A trigg-input (32) receives a signal picked up at the main shaft of the loom. This signal is applied to the input of an opto-electronical coupling element (33), the output thereof being connected to pin No. 39 of the microprocessor (20). The trigg-signal serves to synchronize the operation of the loom with the operation of the microprocessor (20) controlling the yarn storing, feeding and measuring device (1). More particularly, the occurrence of the trigg-signal indicates that the next weft yarn is to be inserted.

A reset input (34) is connected through a reset input interface circuit (35) to input pin No. 5 of the microprocessor (20). Each time the main power of the device is switched on, a reset pulse is fed to the reset input (34) so as to reset the microprocessor (20) for ensuring that the calculation carried out by the microprocessor (20) begins with the first step of the programme.

Input pins No. 7, 20 and 25 of the microprocessor (20) are connected to ground.

Pins Nos. 12–19 of the microprocessor (20) are connected through a SIL-resistor network (36) to a +5 volt potential. Said SIL-resistor network (36) consists of eight resistors, each of them connecting one of these input pins with the +5 volt potential. Hence, each of the input pins Nos. 12–19 of the microprocessor (20) usually have a potential of +5 volts. Input pins Nos. 16–19 are connectable to ground via a so-called DIP-switch (37). Input pin No. 19 of the microprocessor (20) is connected to a test-switch (38), wherein the second input terminal of said test-switch (38) is connected to ground. By adaptively setting the DIP-switch (37) and by opening and closing of the test switch (38) a desired bit-combination can be fed to input pins Nos. 16–19 of the microprocessor (20) causing the actuation and deactuation of a respective group of stopping devices (10) by switching on or switching off an actuation current fed to their associated electromagnetic coils (11). By doing so, it is possible to check the correct operation of the respective yarn stopping devices. Such a checking can be considered as a test-operation of the respective yarn stopping devices.

There is provided a yarn length setting switch (39), preferably consisting of three BCD-switches (40–42), each BCD-switch (40–42) having four input terminals and one output terminal. Each of the BCD-switches can be set to a decimal number from zero-9. This decimal number is converted by the respective BCD-switch (40–42) such that the corresponding one of its four input terminals is connected to its output terminal in accordance with the BCD-code. When for example setting one of the BCD-switches (40–42) to the decimal number 5, then its first and third input terminal is connected to its output terminal, wherein its second and fourth input terminal is disconnected from the output terminal. The respective first input terminals of the BCD-switches (40–42) are connected via diodes to input pin No. 12 of the microprocessor (20), the respective second input terminals of the BCD-switches (40–42) are connected via diodes to input pin No. 13 of the microprocessor (20), the respective third input terminal of the BCD-switches (40–42) are connected via diodes to input pin No. 14 of the microprocessor (20) and the respective fourth input terminals of the BCD-switches (40–42) are connected via diodes to input pin No. 15 of the microprocessor (20). The respective output terminals of the BCD-switches (40–42) are connected to input pins Nos. 36–38 of the microprocessor (20). Due to the provision of the SIL-resistor netowrk (36), each of the input pins Nos. 12–15 of the microprocessor (20) are in their normally "high" state. Usually, although the input pins Nos. 36–18 of the microprocessor (20) are in the normally "high" state. For reading the BCD-value of one of the switches (40–42), the microprocessor (20) pulls down the voltage of one of its input pins Nos. 36–38. For example, for reading the BCD-value of BCD-switch (40), the microprocessor sets its input pin No. 36 to zero potential, i.e. to the "low" logical state. In case the decimal number selected by switch (40) is "5" the voltage of input pins Nos. 12 and 14 of the microprocessor (20) will be pulled down to zero potential, i.e. to the "low" logical state, wherein the logical state of input pins Nos. 13 and 15 remains at "high" logical state.

Reference numeral 43 designates a reset line (43) connected through a reset interface circuit (44) to a reset input pin No. 4 of the microprocessor (20). Each time the main power of the loom is switched on, a pulse signal is fed to the reset line (43) for resetting the microprocessor (20). In other words, this reset line guarantees that the microprocessor begins to carry out the control programme with the first step after switching on the main power of the loom.

Output pins Nos. 27–34 of the microprocessor (20) are connected to input pins Nos. 1–8 of an amplifier circuit (45), this amplifier circuit (45) having eight output terminals number 11–18, each of these output terminals being associated to a respective input pin. When receiving an input signal of "high" logical state at its input pins Nos. 1–8, the amplifier circuit (45) connects the corresponding output terminal to a voltage source having a potential of −35 volts. Each of the output terminals Nos. 11–18 of the amplifier circuit (45) is connected to three electromagnetic coils (11). Twenty-four electromagnetic coils (11) associated to twenty-four yarn stopping devices (10) are arranged as a matrix having eight rows and three columns. The respective output terminals of the electromagnetic coils (11) arranged in one column are connected to a respective one of three output lines (46–48).

Output pins Nos. 22–24 are connected to respective first input terminals of NAND-gates (49–51), the respective second input terminal of these NAND-gates (49–51) being connected to output pin No. 21 of the microprocessor (20). The output terminals of the NAND-gates (49–51) are respectively connected through current amplifier circuits (52–54) to a respective pair of input pins Nos. 1–6 of a amplifier circuit (35). This amplifier circuit (55) includes three pairs of output terminals Nos. 11–16, each pair being connected to a respective one of the lines (46–48). When receiving a "high" logical signal at one of its pairs of input terminals, the amplifier circuit (55) connects the corresponding pair of output terminals to a voltage source having a +5 volt potential. Due to the above described circuit arrangement, the microprocessor (20) is enabled to energize one of the twenty-four electromagnetic coils (11) by generating a high output signal at one of the output pins Nos. 27–34 determining the row of the coil (11) to be actuated, by generating an enable-signal at its output pin No. 21 and by generating a "high" output signal at one of its output pins Nos. 22–24 selecting the column of the electromagnetic coil (11) to be actuated. The above described matrix-arrangement allows to actuate one electromagnetic coil (11) among the twenty-four electromagnetic coils (11) with only eleven output pins Nos. 22–24, 27–34. The microprocessor (20) generates a stobe-signal at its output pin No. 21 causing the periodical switching on and off of the actuation current flowing through the selected one of the electromagnetic coils (11). By strobing the actuation current it is possible to reduce the average power consumption, although a high magnetic actuation force generated by the selected electromagnetic coil (11) can be maintained due to the high peak-value of the actuation current.

It has turned out that a high magnetic force as generated by the determined electromagnetic coil (11) is only necessary for moving the stopping element (14) into the actuated position. Such a high magnetic force is generated during the first peak of the subsequent row of peaks of the actuation current fed to said coil (11). The average magnetic holding force corresponding to the average level of the subsequent peaks of the actuation current can be chosen to be essentially lower for maintaining the actuated stopping element (14) in the "yarn stop" position. By adaptively choosing the time relationship between "on" and "off" periods of time of the actuation current it is possible to adapt the time-dependency of the magnetic force as generated by the actuation current flowing through the determined electromagnetic coil (11) to the required time-dependency of the actuation force of the corresponding yarn stopping device (10).

Output pin No. 34 of the microprocessor (20) is connected through a current amplifier (56) to a light-emitting element (57), which in turn is connected to ground via a resistor (58). The light-emitting element (57) actuates an opto-sensitive switching element (59) actuating a stop-motion-relay (not shown here) of the weaving machine.

Output pin No. 35 of the microprocessor (20) is connected through a current amplifier (60) to a light-emitting element (61), which in turn is connected via a resistor (62) to ground. The light-emitting element (61) actuates an opto-sensitive switching element (63), which in turn is connected to a relay controlling the operation of the valve of the main jet nozzle of the loom (not shown here).

The amplifier circuit (45) is a standard-circuit element of the type "UDN 2580A". The amplifier circuit (35) is also a standard-circuit element of the type "UCN 2002A". Both amplifier circuits are available from "SPRAGUE" Corporation.

Figure 6A:
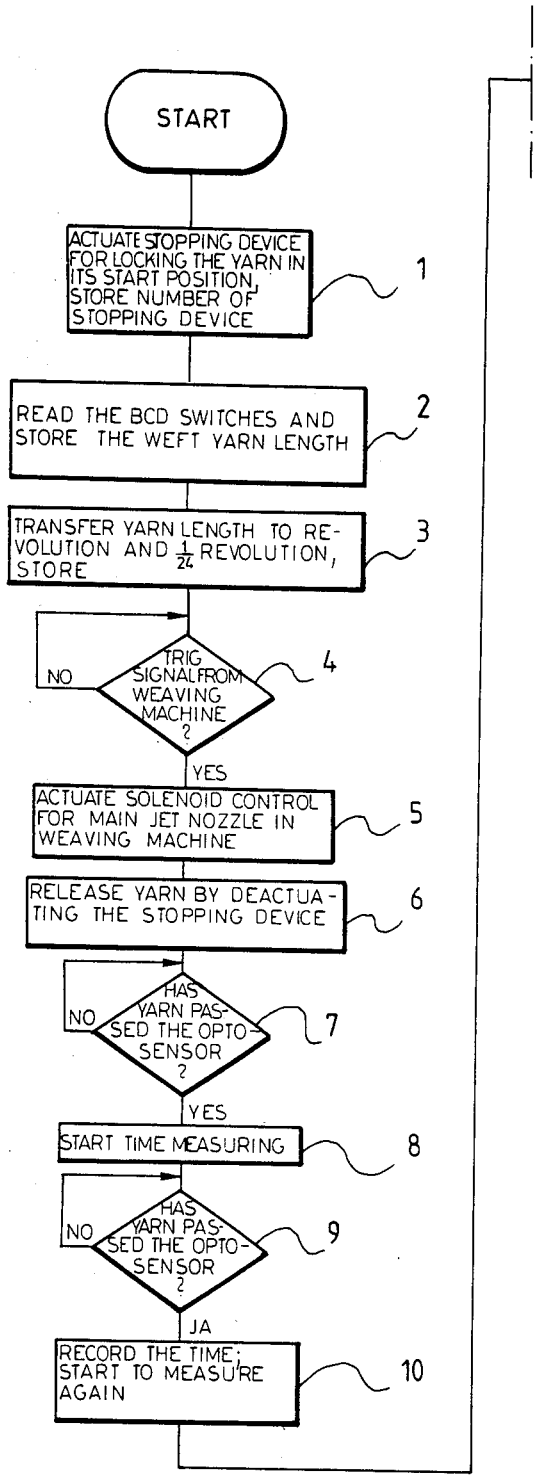
FIG. 6 shows a flow-diagram used in a microprocessor of the control device as shown in FIG. 5.
Figure 6B:
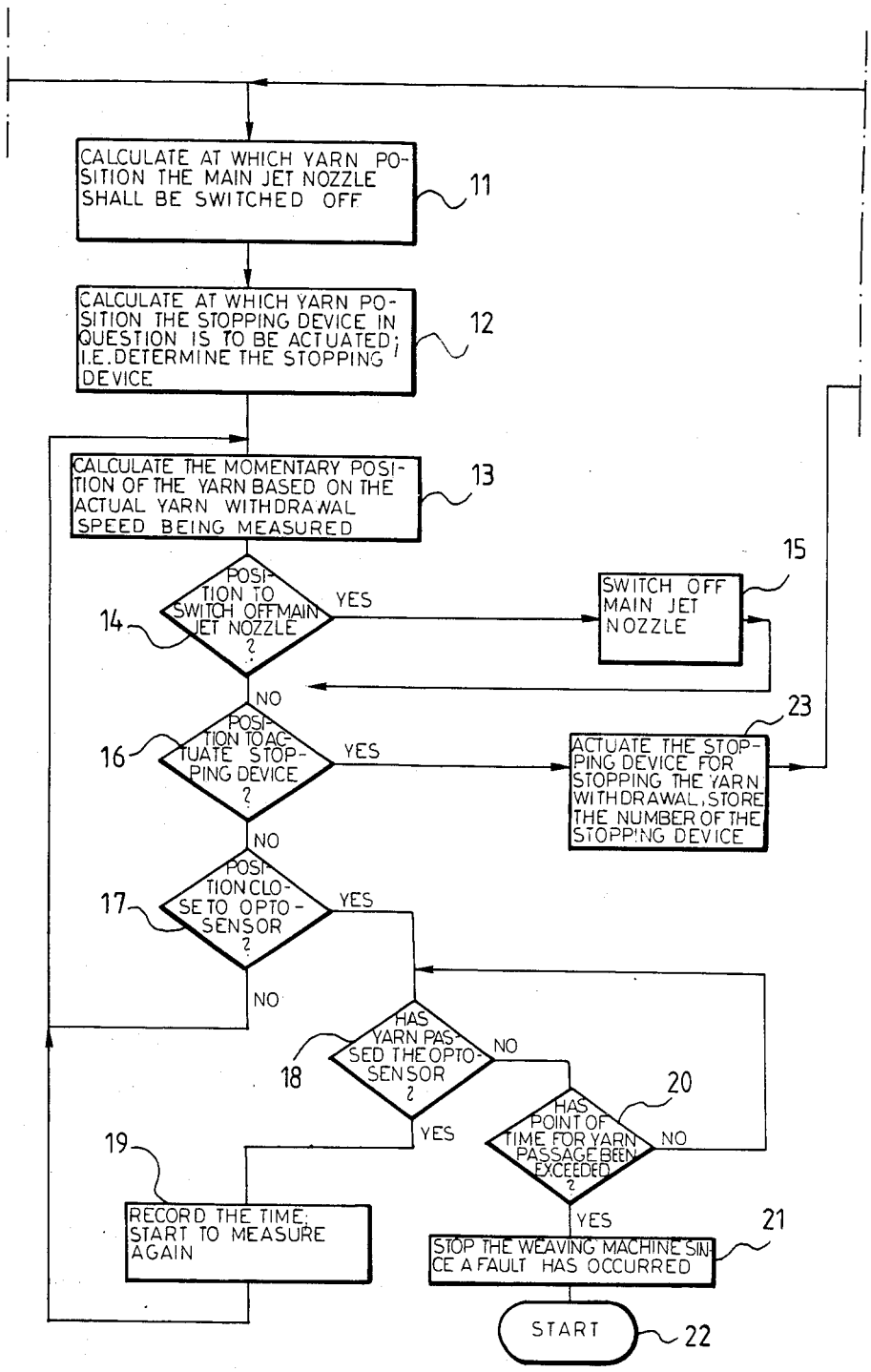
Figure 6C:
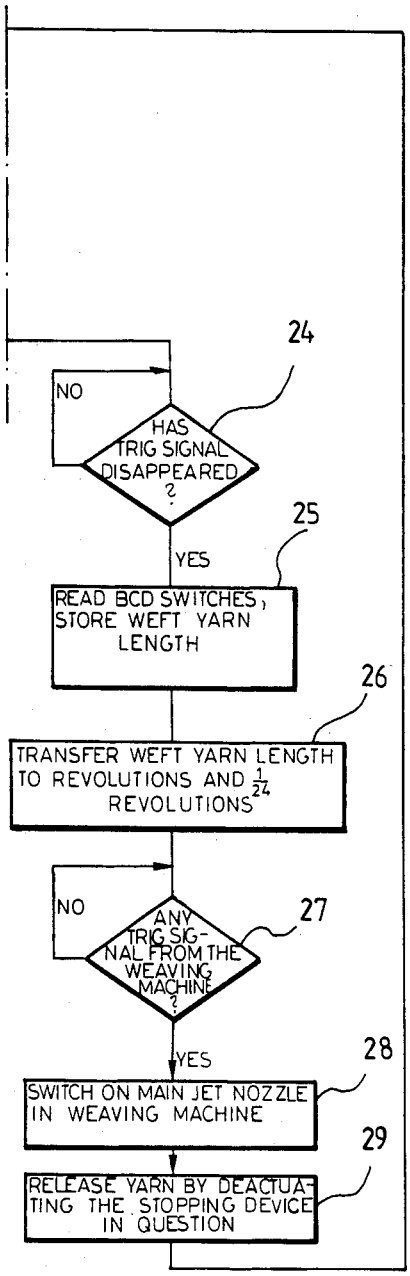

Referring now to FIG. 6, there is shown a flow-diagram of the control-programme stored in the read-only memory of the microprocessor (20). When receiving a reset-signal, the microprocessor (20) is reset so as to start the carrying out of the programme with the first instruction thereof, being the "START" instruction.

At programme step No. 1, the microprocessor (20) actuates a predetermined yarn stopping device (10) for locking the yarn (F) in its start position. Preferably, said stopping device (10) is selected such that its angular position is 180° offset with respect to the angular position of the yarn sensor (6). The microprocessor (20) stores the number or the angular position of said stopping device in a pre-determined storage cell of its RAM.

At programme step No. 2, the microprocessor (20) consecutively reads the BCD-code of the switches representing the desired weft yarn length and stores the corresponding BCD-codes in pre-determined storage cells of its RAM.

At programme step No. 3, the microprocessor (20) transfers or converts the BCD-codes representing the desired weft yarn length to a digital value corresponding to the number of revolutions and 1/24 revolutions, wherein this digital value represents the revolutions of the withdrawal point of the yarn during the withdrawal of the desired weft yarn length. It is also possible to express said desired weft yarn length by a value corresponding to the time required for withdrawing said desired weft yarn length.

At programme step No. 4 is a waiting routine, causing the microprocessor (20) to await the receipt of a trigg-signal from the weaving machine before going to programme step No. 5. This waiting routine is realised by a programme loop periodically checking whether the trigg-signal occurs. If said condition is fulfilled, the microprocessor continues with the programme step No. 5.

At programme step No. 5, the microprocessor generates a "high" signal at its output pin No. 35 for actuating the relay controlling the valve of the main jet nozzle in the weaving machine.

At programme step No. 6, the stopping device (10) actuated during programme step No. 1 is deactuated for releasing the yarn (F). At programme step No. 7, the microprocessor (20) checks whether the yarn passes the yarn sensor by repeatedly checking the logical states of its input pins Nos. 1 and 6. If this condition is fulfilled, the microprocessor (20) continues with programme step No. 8.

At programme step No. 8, the microprocessor (20) begins with the measuring of the time lapsing since the generation of the pulse signal indicating that passing of the yarn through the detection area of the yarn sensor (6).

At programme step No. 9, the microprocessor (20) again carries out a waiting loop corresponding to the waiting loop of programme step No. 7. As soon as the yarn has passed the yarn sensor (6), microprocessor (20) continues with the programme step No. 10.

At programme step No. 10, the microprocessor (20) stores the time between two subsequent pulse signals as received from yarn sensor (6). The microprocessor (20) then starts again to measure the time.

At programme step No. 11, the microprocessor (20) calculates at which yarn position the main jet nozzle is to be switched off.

At programme step No. 12, the microprocessor (20) calculates at which yarn position the stopping device (10) determined during programme step No. 3 is to be actuated.

At programme step No. 13, the microprocessor (20) calculates the momentary position of the yarn based on the actual yarn withdrawal speed being measured during programme step No. 10.

At programme step No. 14, the microprocessor (20) checks whether the calculated, momentary position of the yarn as determined during programme step No. 13 equals the yarn position determined during programme step No. 11. If this condition is fulfilled, the microprocessor (20) continues with programme step No. 15. If not, it continues with programme step No. 16.

At programme step No. 15, the microprocessor (12) switches off the main jet nozzle by pulling down its output pin No. 35 to zero potential.

At programme step No. 16, the microprocessor (20) checks whether the calculated, momentary position of the yarn as determined during programme step No. 13 corresponds to the yarn position as calculated during programme step No. 12. If so, the microprocessor (20) goes to programme step No. 23. Otherwise, it continues with carrying out programme step No. 17.

At programme step No. 17, the microprocessor (20) checks whether the calculated position as determined during programme step No. 13 is close to the position of the yarn sensor (6). By doing so, a time-window is realised. In case this condition is not fulfilled, the microprocessor (20) goes back to programme step No. 13. It it is fulfilled, it continues with programme step No. 18.

At programme step No. 18, the microprocessor (20) agan checks whether the yarn has passed the yarn sensor (6). This programme step corresponds to programme step No. 7. If this condition is fulfilled, the microprocessor (20) continues with programme step No. 19. Otherwise, it continues with programme step No. 20.

At programme step No. 19, the microprocessor (20) stores the measured time between two subsequent pulse signals as received from yarn sensor (6) and goes back to programme step No. 13.

At programme step No. 20 is a safety-routine for checking whether a yarn breakage occurred. This safety-routine is realised by comparing the calculated time with a time threshold which is only exceeded in case of a yarn breakage. In other words, the microprocessor (20) checks whether the measured time lapsed since the last passing of the yarn through the detection area of the yarn sensor (6) exceeds a time threshold. If this condition is not fulfilled, the microprocessor (20) continues with programme step No. 18, wherein otherwise it goes to programme step No. 21.

At programme step No. 21, the weaving machine is stopped since a yarn breakage has occurred. For this purpose, the microprocessor (20) generates a "high" logical potential signal at its output pin No. 34.

At programme step No. 22, the microprocessor (20) goes back to the start-instruction of the programme when having received a reset-signal.

At programme step No. 23, the microprocessor (20) actuates the stopping device (10) for stopping the yarn withdrawal. Furthermore, the microprocessor (20) stores the number of the actuated stopping device in a pre-determined storage cell of its RAM.

At programme step No. 24, the microprocessor (20) checks whether the trigg-signal as received at programme step No. 4 has disappeared in the meantime. As soon as the trigg-signal disappears, the microprocessor goes to programme step No. 25.

At programme step No. 25, the microprocessor (20) carries out a programme step corresponding to programme step No. 2.

At programme step No. 26, the microprocessor (20) carries out a programme step corresponding to programme step No. 3.

At programme step No. 27 is a waiting routine for repeatedly checking whether a trigg-signal is fed to the trigg-input (32). Such a trigg-signal indicates that the loom is ready for the insertion of a further weft yarn. As soon as the trigg-signal is generated, the microprocessor (20) goes to programme step No. 28.

At programme step No. 28, the microprocessor (20) switches on the main jet nozzle of the weaving machine by generating a "high" logical potential signal at output pin No. 35.

At programme step No. 29, the microprocessor (20) deactuates the stopping device actuated when carrying out the programme step No. 23. The microprocessor (20) then goes back to programme step No. 11.

The embodiments of the invention in which an exclusive property or privilege is claimed are defined as follows:

1. In a yarn storing, feeding and measuring device for jet looms, having a stationary storage drum onto which an intermediate yarn store is wound by a winding-on device and from which the yarn is withdrawn spiralling around a withdrawal end of said storage drum, yarn sensing means arranged such that the yarn periodically passes its detection area during withdrawal from the drum, said yarn sensing means producing a pulse signal each time the yarn passes the detection area of said yarn sensing means, a plurality of independently actuable yarn stopping devices arranged at spaced angular intervals around said storage drum, said yarn stopping devices including yarn stopping elements and actuator means for moving said stopping elements into and out of the path of the yarn being withdrawn, and an actuator control device having means for selecting a desired yarn length to be withdrawn, said control device being responsive to said pulse signals in such a way that an actuating signal is transmitted to a selected yarn stopping device whose angular position corresponds to the angular position of the yarn when the desired yarn length has been withdrawn, the improvement comprising wherein said yarn sensing means includes at least one yarn sensor, the number thereof being less than and independent from the number of said yarn stopping devices, and wherein said control device includes storing means for storing information regarding the yarn stopping device actuated at the end of a previous yarn withdrawal cycle and calculating means for selecting one said yarn stopping device which is to be actuated next on the basis of input information representing said desired yarn length and on the basis of said stored information.

2. Device as claimed in claim 1, wherein said yarn sensing means has only a single said yarn sensor.

3. Device as claimed in claim 2, wherein said stored information regarding the yarn stopping device actuated at the end of the previous withdrawal cycle indicates the relative angular position of such stopping device with respect to said yarn sensor.

4. Device as claimed in claim 1, wherein said calculating means determines on the basis of the desired yarn length an actuation position of the withdrawal point of the yarn being withdrawn from said storage drum at which said selected stopping device is to be actuated, wherein said calculating means measures the period of time between the occurrence of two successive pulse signals generated by the yarn sensor (6), wherein said calculating means calculates the momentary position of the withdrawal point of the yarn being withdrawn from the storage drum with respect to the respective position of each said yarn stopping device on the basis of said measured period of time, and wherein said calculating means actuates said selected stopping device as soon as the calculated momentary position equals said actuation position.

5. Device as claimed in claim 4, wherein said calculating means carries out the following steps for determining the momentary position of the withdrawal point of the yarn:

(a) Setting the calculated momentary position to a value corresponding to the position of said stopping device actuated at the end of the previous yarn withdrawal cycle, (b) Incrementing the calculated momentary position at a predetermined rate, checking whether the calculated momentary position equals the position of said yarn sensor, and checking whether the calculated momentary position equals said actuation position, (c) In case the calculated momentary position equals the position of said yarn sensor, holding the calculated momentary position and waiting until the yarn sensor generates a pulse signal; and going back to step (b) as soon as the yarn sensor generates a pulse signal, the generation of the pulse signal indicating that the calculated momentary position equals the real position of the withdrawal point of the yarn, and (d) In case the calculated momentary position equals said actuation position, actuating said selected stopping device.

6. Device as claimed in claim 4, wherein said actuation position of the withdrawal point of the yarn being withdrawn from said storage drum is determined such that the period of time lapsing during the movement of the withdrawal point of the yarn from said actuation position to the position of the stopping element of said selected stopping device is greater than the response time of said selected stopping device, said response time being defined as the time delay between feeding an actuation current to the actuator means of the stopping device and the completing of the movement of the stopping element thereof.

7. Device as claimed in claim 4, wherein said jet loom includes a jet nozzle for inserting the weft yarn during the process of weaving by means of compressed air, wherein the jet of compressed air generated by the jet nozzle can be controlled by means of an electromagnetic valve operable by a driving current for controlling the feeding of compressed air to said nozzle, and wherein said calculating means is electrically connected to said valve for controlling the opening and closing thereof in time-dependency from the actuation of the respective stopping devices.

8. Device as claimed in claim 7, wherein said calculating means is arranged to open said valve a pre-determined period of time before deactivating the stopping device actuated at the end of the previous yarn withdrawal cycle and to close said valve a pre-determined period of time before activating said selected stopping device.

9. Device as claimed in claim 8, wherein said predetermined period of time corresponds to the response time of said valve and said jet nozzle, said response time being defined as the time delay between feeding a driving current to said electromagnetic valve and the point in time at which the jet of compressed air is completely established.

10. Device as claimed in claim 1, wherein the calculating means determines on the basis of the desired yarn length an actuation time defining the period of time between releasing the stopping device actuated at the end of the previous withdrawal cycle and actuating of said selected stopping device, wherein said calculating means calculates the period of time lapsed since the deactuation of said stopping device actuated at the end of the previous withdrawal cycle, wherein said calculating means corrects this calculation of the period of time on the basis of the periods of time between successive pulse signals received from said yarn sensor, and wherein said calculating means generates an actuation signal for actuating the actuator means of said selected stopping device as soon as the calculated period of time is equal to said actuation time.

11. Device as claimed in claim 10, wherein the calculated period of time lapsed since the deactuation of said stopping device actuated at the end of the previous withdrawal cycle represents an angular position of the withdrawal point of the yarn being withdrawn from the storage drum.

12. Device as claimed in claim 10, wherein said calculating means carries out the following steps for calculating the period of time lapsed since the deactuation of said stopping device actuated at the end of the previous withdrawal cycle:

(a) Resetting a value to zero when deactuating the stopping device actuated at the end of the previous withdrawal cycle, said value representing said calculated period of time, (b) Incrementing said value at a pre-determined rate and checking:

(bi) Whether said value equals said actuation time and (bii) Whether said value is an integer multiple of a pre-set time, said preset time being slightly smaller than the period of time lapsing during the withdrawal of one turn of yarn from said storage drum, (c) In case condition (bi) is fulfilled, generating an actuation signal to said selected stopping device, (d) In case condition (bii) is fulfilled, holding said value equal to said integer multiple of said pre-set time pending receipt of a pulse signal from said yarn sensor, (e) Waiting until said yarn sensor generates the next pulse signal, and (f) Going back to step (b) as soon as condition (e) is fulfilled.

13. Device as claimed in claim 1, wherein said calculating means includes a microprocessor.

14. Device as claimed in claim 1, wherein each said yarn stopping element is a metal ball movably disposed in a radial bore provided in a guiding portion located close to the withdrawal end of said storage drum, wherein each said actuator means includes an electromagnetic coil arranged in spaced relationship to said guiding portion so as to define a gap between said guiding portion and the coil, the yarn being withdrawn through said gap, and wherein the metal ball is attracted by the coil when the coil is supplied with the actuation current so that the metal ball moves into said gap for stopping the withdrawal of the yarn.

15. Device as claimed in claim 14, wherein each said stopping device includes a permanent magnet located at one end of said bore for moving said metal ball into said bore when the actuation current is switched off.

16. Method for controlling a loom having a yarn storing, feeding and measuring device which includes a storage drum on which a yarn is wound, a plurality of stopping devices arranged at spaced angular locations about said drum, and a yarn sensor which generates a signal each time the yarn passes its detection area during withdrawal from said drum, comprising the steps of:

calculating an actuation time on the basis of a desired yarn length, said actuation time defining the period of time between deactuation of one of said stopping devices which was actuated at the end of the immediately preceding withdrawal cycle and actuation of a selected one of said stopping devices which is to be actuated next, measuring the period of time which has elapsed since deactuating said previously actuated stopping device, correcting said measured period of time on the basis of the signal generated by said yarn sensor, and actuating said selected stopping device as soon as said corrected period of time corresponds to said calculated actuation time.

17. Method as claimed in claim 16, wherein said step of correcting said measured period of time includes the step of measuring the period of time between two successive pulses received from said yarn sensor.

18. Method as claimed in claim 16, wherein said step of calculating said actuation time is carried out so that the period of time required for movement of the withdrawal point of the yarn from its angular position at the moment of actuating said selected stopping device to the angular position of said selected stopping device is greater than the response time of said selected stopping device, said response time being the time delay between feeding an actuation current to said selected stopping device and completion of the movement thereof.

19. Method as claimed in claim 16, wherein said step of measuring the period of time lapsed since deactuation of said previously actuated stopping device includes the steps of:

(a) resetting a value to zero when deactuating said previously actuated stopping device, said value representing said calculated period of time, (b) incrementing said value at a predetermined rate, and checking:

(bi) whether said value equals said actuation time, and (bii) whether said value is an integer multiple of a pre-set time, said pre-set time being smaller than the period of time lapsing during withdrawal of one turn of yarn from said storage drum, (c) in case condition (bi) is fulfilled, generating an actuation signal for said selected stopping device, (d) in case condition (bii) is fulfilled, holding said value equal to said integer multiple of said preset time pending receipt of a pulse signal from said yarn sensor, (e) waiting for said yarn sensor to generate the next pulse signal, and (f) going back to method step (b) as soon as condition (e) is fulfilled.

20. Method as claimed in claim 16, wherein said loom is a jet loom having a jet nozzle for inserting the yarn withdrawn from said drum, and including the step of using said measured period of time for controlling the actuation of a valve associated with said jet nozzle in time-dependency from the actuation of said selected stopping device.

21. Method as claimed in claim 20, wherein said step of controlling said valve includes the steps of opening said valve a predetermined period of time before deactuating said previously actuated stopping device and closing said valve a predetermined period of time before actuating said selected stopping device.

22. Method as claimed in claim 21, wherein said predetermined period of time corresponds to the response time of said valve and said nozzle, said response time being the time delay between feeding a driving current to said valve and the point in time at which the jet of compressed air has been completed established.

23. Method for controlling a loom having a yarn storing, feeding and measuring device which includes a storage drum on which a yarn is wound, a plurality of stopping devices arranged at spaced angular locations about said drum, and a yarn sensor which generates a pulse signal each time the yarn passes its detection are during withdrawal from said drum, comprising the steps of:

calculating on the basis of a desired yarn length an actuation position of the withdrawal point of the yarn at which a selected one of said stopping devices is to be actuated, measuring the period of time between successive pulse signals generated by said yarn sensor, calculating the momentary position of the withdrawal point of the yarn utilizing said measured periods of time between successive pulse signals from said yarn sensor, and actuating said stopping device as soon as said calculated momentary position equals said calculated actuation position.

24. Method as claimed in claim 23, wherein said step of calculating said actuation position is carried out so that the period of time which will elapse during movement of the withdrawal point of the yarn from said actuation position to the position of said selected stopping device is greater than the response time of said selected stopping device, said response time being the time delay between feeding an actuation current to said selected stopping device and completion of the movement thereof.

25. Method as claimed in claim 23, wherein said loom is a jet loom having a jet nozzle for inserting the yarn withdrawn from said drum, and including the step of using said calculated momentary position for controlling the actuation of a valve associated with said jet nozzle in time-dependency from the actuation of said selected stopping device.

26. Method as claimed in claim 25, wherein said step of controlling said valve includes the steps of opening said valve a predetermined period of time before deactuating said previously actuated stopping device and closing said valve a predetermined period of time before actuating said selected stopping device.

27. Method as claimed in claim 26, wherein said predetermined period of time corresponds to the response time of said valve and said nozzle, said response time being the time delay between feeding a driving current to said valve and the point in time at which the jet of compressed air has been completely established.

* * * * *